United States Patent [19]

Yamada et al.

[11] Patent Number: 4,764,400

[45] Date of Patent: Aug. 16, 1988

[54] WOODEN PATTERN APPLYING METHOD

[76] Inventors: Kunio Yamada, 4-5-14 Hibarigaoka Kita Hoya cho, Tokyo; Susumu Maeide, 134-5 Nishi Katsuragicho Yamanaka cho, Numagoorigun, Ishikawa ken, Japan

[21] Appl. No.: 903,358

[22] Filed: Sep. 3, 1986

[51] Int. Cl.[4] ..... B05D 5/00

[52] U.S. Cl. ..... 427/280; 427/287; 427/288

[58] Field of Search ..... 427/262, 393, 420, 280, 427/287, 288

[56] References Cited

U.S. PATENT DOCUMENTS

| | | | |
|---|---|---|---|
| 3,017,287 | 1/1962 | Berry et al. | 427/393 X |
| 3,421,932 | 6/1969 | McGregor, Jr. et al. | 427/420 |
| 3,493,418 | 2/1970 | Amano | 427/262 |
| 3,499,783 | 3/1970 | Nelson | 427/393 X |
| 3,738,854 | 6/1973 | Oishi | 427/262 |
| 4,019,906 | 4/1977 | Ridley | 427/420 X |
| 4,060,649 | 11/1977 | Coleman | 427/420 X |
| 4,268,928 | 5/1981 | Grüber | 427/420 X |

FOREIGN PATENT DOCUMENTS

| | | | |
|---|---|---|---|
| 49-104932 | 10/1974 | Japan | 427/262 |

*Primary Examiner*—Thurman K. Page
*Attorney, Agent, or Firm*—Donald D. Mon

[57] ABSTRACT

A method of treating a body to produce a wood like appearance. A treating material is created by combining urethane mixtures aged different periods of time, from as little as one day up to five days, respectively. The combined mixture is allowed to flow into a water bath to create a line stream. The body to be treated is immersed in the water bath in the path of the line stream, removed and then dried. The treating material adhering to the body creates a wood-like appearance.

5 Claims, 2 Drawing Sheets

WOODEN PATTERN APPLYING METHOD

FIELD OF THE INVENTION

This invention relates to a method of applying a wooden pattern to the surface of bodies such as golf club heads, trays, furniture, paper, stainless steel, plastic, iron, brass, ceramics, glasses or the like.

BACKGROUND OF THE INVENTION

Heretofore, methods for applying (or printing) a wooden pattern on the body surface of a metal golf club head, is by immersing the body into a vessel in which a painting liquid, chiefly consisting of urethane resins, is flowing in one direction. However the pattern produced is a veneer like stripe pattern not having a good appearance.

BRIEF DESCRIPTION OF THE INVENTION

The object of this invention is to produce a wooden pattern resembling a persimmon tree (Japanese kaki tree) or a zelkova tree (Japanese Keyaki tree).

In this invention the painting liquid is a combination of new liquid mixtures and old liquid mixtures of said urethane resin. These new and old liquids are mixed in suitable ratio. By using this mixed painting liquid, a wooden pattern like a persimmon tree (Japanese kaki tree) or a zelkova tree (Japanese keyaki tree) can be produced on an object.

The above and other objects, advantages and novel features of the invention will be more fully understood from the following detailed description and the accompanying drawings.

BRIEF DESCRIPTION OF THE DRAWINGS

FIG. 3(*b*) is a longitudinal cross-sectional view of a painting vessel of FIG. 3(*a*).

DETAILED DESCRIPTION OF THE INVENTION

Figure 1:
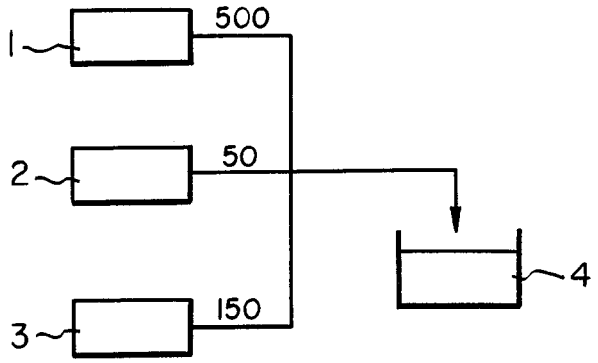
FIG. 1 shows a block diagram of the mixed painting liquid according to this invention.

As shown in FIG. 1, a painting liquid produced according to this invention is a mixture 4, of 500 parts urethane resin 1, (nitrose lacquer manufactured by Sanyo chemical KK); 50 parts curing agent 2; and 150 parts distilled water 3. Mixture 4 should not be stirred and used 3–4 hours after mixing.

Figure 2:
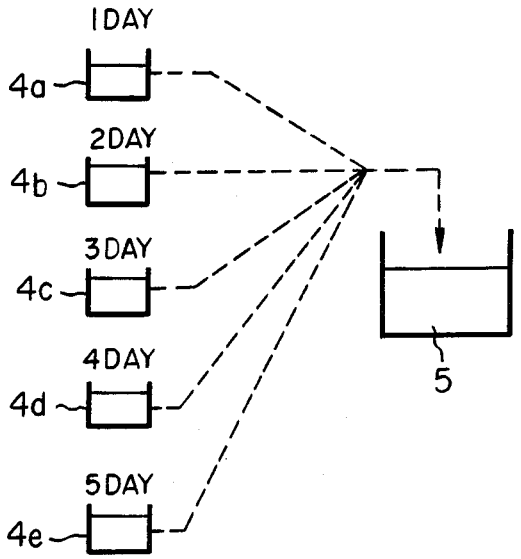
FIG. 2 is an explanatory illustration of the mixing of the painting liquid of this invention.

As shown in FIG. 2 separate mixtures 4 are stored in bottles as liquids 4*a*,4*b*,4*c*,4*d*,and 4*e* for 1 day, 2 days, 3 days, 4 days, and 5 days respectively. Older liquids 4*d* –4*e* generate a bubble. At least 3 of new and old liquids 4*a* through 4*e* are mixed to produce a combined mixture. For example old liquids 4*d* , 4*e* and new liquid 4*a*,4*b* are mixed to create new combined mixture 5.

Figure 3A:
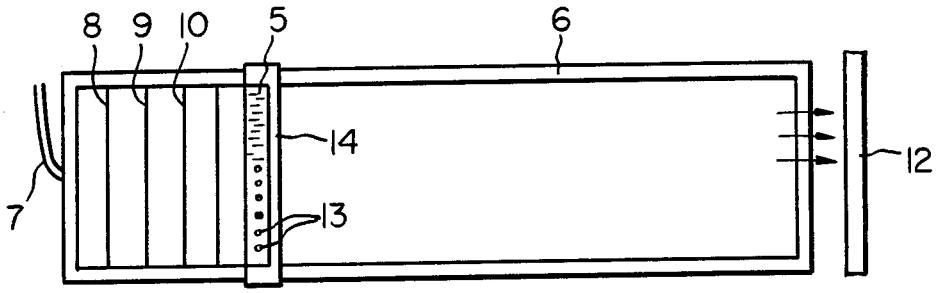
FIG. 3(*a*) is a plan view of a vessel having a painting liquid according to this invention.
Figure 3B:
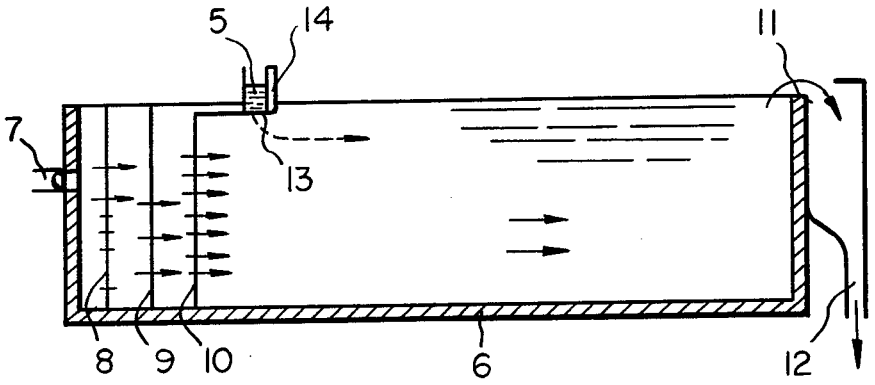

As shown in FIGS. 3(*a*) and (*b*) water pipe 7 is connected to an end of rectangular shaped elongate vessel 6 and water from pipe 7 flows uniformly through perforated plates 8, 9, 10, having many small holes, into vessel 6 at a ratio of 1–10 cm/sec toward the other end and overflows end 11 into drain 12.

New combined mixture 5 is placed in container 14 having many nozzles 13, 13, . . . at the bottom. Nozzles 13 are positioned 1.5–2.0cm under the water surface. New mixture 5 flows from nozzles 13 in a line stream as shown by the dotted line.

Thus, to apply mixture 5 to a body (not shown) it is immersed into the line stream in vessel 6 causing the linear mixture to become attached to the surface. The body is then picked up out of the water, and dried.

As explained above, in this invention the painting liquid is composed of a combination of new and old liquids, and a wooden pattern is formed by the new liquid mixture on a body which pattern is caused by the bubbles in the old liquid. A line in the shape of an annular ring of wood, and dots in the shape of a pear skin lacquer are formed at the same time on the body so that a wooden pattern like a persimmon tree (Japanese kaki tree) or a zelkova tree (Japanese keyaki tree) is formed on a body such as a golf club head which gives a good appearance to the user and the feel of a wood head golf club.

I claim:

1. A method of treating a body to produce a wooden pattern appearance comprising;

preparing a plurality of mixtures consisting of a urethane, a curing agent and distilled water;

curing said plurality of mixtures by aging them for varying periods of from 5 days to 1 day;

preparing a combined mixture of said plurality of mixtures of at least one mixture aged a short time with at least one mixture aged a longer time of up to 5 days;

flowing water through an elongate vessel;

positioning a container having nozzles and said combined mixture in the path of said water flowing through said elongate vessel to create a stream of said combined mixture;

immersing a body to be treated in the path of said stream;

removing and drying said body whereby a wooden appearing pattern is created on said body.

2. The method according to claim 1 in which said plurality of mixtures comprise; 500 parts nitrose lacquer urethane; 50 parts curing agent and 150 parts distilled water.

3. The method according to claim 1 in which said plurality of mixtures comprise 5 mixtures aged respectively 1 to 5 days each.

4. The method according to claim 3 in which said combined mixture includes at least three of said aged combined mixtures.

5. The method according to claim 4 in which said combined mixtures includes a mixture containing mixtures aged one and two days with mixtures aged four and five days.

* * * * *